US007886424B2

(12) United States Patent
Pauley, Jr. et al.

(10) Patent No.: US 7,886,424 B2
(45) Date of Patent: Feb. 15, 2011

(54) METHOD OF FORMING A DISC-WOUND TRANSFORMER WITH IMPROVED COOLING AND IMPULSE VOLTAGE DISTRIBUTION

(75) Inventors: William E. Pauley, Jr., Bland, VA (US); Charlie H. Sarver, Rocky Gap, VA (US); Rush B. Horton, Jr., Wytheville, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/721,613

(22) Filed: Mar. 11, 2010

(65) Prior Publication Data

US 2010/0162557 A1 Jul. 1, 2010

Related U.S. Application Data

(62) Division of application No. 11/494,087, filed on Jul. 27, 2006, now Pat. No. 7,719,397.

(51) Int. Cl.
*H01F 7/06* (2006.01)

(52) U.S. Cl. ..... 29/605

(58) Field of Classification Search ..... 29/602.1, 29/605; 336/65, 170, 173, 180–186
See application file for complete search history.

(56) References Cited

U.S. PATENT DOCUMENTS

| | | | | |
|---|---|---|---|---|
| 3,170,225 | A * | 2/1965 | Gray et al. | 29/605 |
| 3,464,043 | A | 8/1969 | Benko et al. | |
| 3,958,201 | A | 5/1976 | Henderson | |
| 4,000,482 | A | 12/1976 | Staub et al. | |
| 4,486,730 | A | 12/1984 | Broszat | |
| 4,864,266 | A | 9/1989 | Feather et al. | |
| 5,167,063 | A | 12/1992 | Hulsink | |
| 5,296,829 | A * | 3/1994 | Kothmann et al. | 336/60 |
| 5,461,772 | A * | 10/1995 | Puri | 29/605 |
| 5,588,201 | A | 12/1996 | Alber et al. | |
| 5,931,404 | A | 8/1999 | Paucher | |
| 6,806,803 | B2 | 10/2004 | Hopkinson et al. | |
| 7,023,312 | B1 | 4/2006 | Lanoue et al. | |
| 2005/0275496 | A1 | 12/2005 | Pauley, Jr. et al. | |

FOREIGN PATENT DOCUMENTS

| | | |
|---|---|---|
| GB | 587997 | 5/1947 |
| GB | 613045 | 11/1948 |
| GB | 741451 | 12/1955 |
| GB | 819038 | 8/1959 |
| GB | 909516 | 10/1962 |
| GB | 918281 | 2/1963 |
| WO | WO/03/107364 | 12/2003 |
| WO | US2007/012765 | 5/2007 |
| WO | WO2008/013600 A3 | 1/2008 |

* cited by examiner

*Primary Examiner*—Tuyen Nguyen
(74) *Attorney, Agent, or Firm*—Paul R. Katterle

(57) ABSTRACT

A method of manufacturing a transformer is provided. The method includes forming a disc-wound coil by forming a first conductor layer, a second conductor layer and a layer of cooling ducts between the first and second conductor layers. The first and second conductor layers each have a plurality of disc windings arranged in an axial direction of the disc-wound coil. Each of the disc windings includes a conductor wound into a plurality of concentric turns.

20 Claims, 11 Drawing Sheets

METHOD OF FORMING A DISC-WOUND TRANSFORMER WITH IMPROVED COOLING AND IMPULSE VOLTAGE DISTRIBUTION

CROSS CROSS-REFERENCE TO RELATED APPLICATION

This application is a divisional application of, and claims priority from, U.S. patent application Ser. No. 11/494,087 filed on Jul. 27, 2006, which is hereby incorporated by reference in its entirety.

BACKGROUND OF THE INVENTION

This invention relates to transformers and more particularly to transformers with a disc wound coil.

As is well known, a transformer converts electricity at one voltage to electricity as another voltage, either of higher or lower value. A transformer achieves this voltage conversion using a primary coil and a secondary coil, each of which is wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

In the layer winding technique, the conductor turns required for a coil are wound in one or more concentric conductor layers connected in series, with the turns of each conductor layer being wound side by side along the axial length of the coil until the conductor layer is full. A layer of insulation material is disposed between each pair of conductor layers. Axially-extending air ducts may also be formed between pairs of conductor layers. In U.S. Pat. No. 7,023,312, pre-formed cooling ducts are inserted between conductor layers during the winding of a coil.

In the disc winding technique, the conductor turns required for a coil are wound in a plurality of discs serially disposed along the axial length of the coil. In each disc, the turns are wound in a radial direction, one on top of the other, i.e., one turn per layer. The discs are connected in a series circuit relation and are typically wound alternately from inside to outside and from outside to inside so that the discs can be formed from the same conductor. An example of such alternate winding is shown in U.S. Pat. No. 5,167,063.

In a transformer with a conventional disc-wound coil, the capacitance between the discs is fairly low in comparison with the capacitance between the discs and ground. As a result, when the transformer is subjected to a steep wave front impulse or transient voltage, such as may occur as a result of a lightning strike, a significant non-linear voltage distribution occurs along the axial length of the coil with a very high voltage gradient appearing at the first few turns adjacent the high voltage end. This high voltage gradient produces significant local dielectric stresses.

In order to increase series capacitance and improve impulse voltage distribution, the discs may be interleaved, i.e., the turns of adjacent discs may be interleaved. An example of a transformer with interleaved discs is shown in U.S. Pat. No. 3,958,201. Forming interleaved discs, however, is complicated and decreases the free space between discs, which adversely affects cooling.

It would therefore be desirable to provide a transformer with disc-wound coils, which has improved impulse voltage distribution and cooling. The present invention is directed to such a transformer and a method for manufacturing such a transformer.

SUMMARY OF THE INVENTION

In accordance with the present invention, a method is provided for manufacturing a transformer. In accordance with the method, a disc-wound coil is formed by forming a first conductor layer having a plurality of serially connected disc windings arranged in an axial direction of the disc-wound coil. Each of the disc windings in the first conductor layer includes a conductor wound into a plurality of concentric turns. A second conductor layer is formed over the first conductor layer. The second conductor layer has a plurality of serially connected disc windings arranged in an axial direction of the disc-wound coil. Each of the disc windings in the second conductor layer includes a conductor wound into a plurality of concentric turns.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
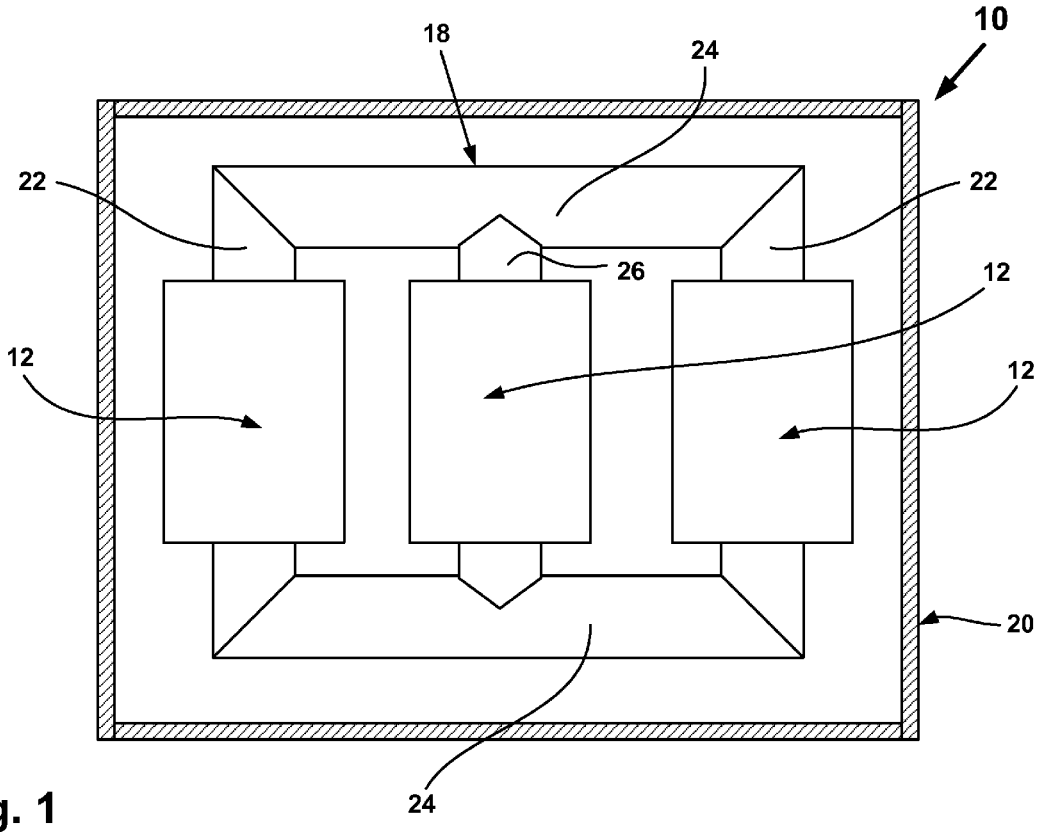
FIG. 1 is a schematic sectional view of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a schematic sectional view of a three phase transformer 10 containing a coil embodied in accordance with the present invention. The transformer 10 comprises three coil assemblies 12 (one for each phase) mounted to a core 18 and enclosed within a ventilated outer housing 20. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The coil assemblies 12 are mounted to and disposed around the outer legs 22 and the inner leg 26, respectively. Each coil assembly 12 comprises a high voltage coil and a low voltage coil, each of which is cylindrical in shape. If the transformer 10 is a step-down transformer, the high voltage coil is the primary coil and the low voltage coil is the secondary coil. Alternately, if the transformer 10 is a step-up transformer, the high voltage coil is the secondary coil and the low voltage coil is the high voltage coil. In each coil assembly 12, the high voltage coil and the low voltage coil may be mounted concentrically, with the low voltage coil being disposed within and radially inward from the high voltage coil, as shown in FIG. 1. Alternately, the high voltage coil and the low voltage coil may be mounted so as to be axially separated, with the low voltage coil being mounted above or below the high voltage coil. In accordance with the present invention, each high voltage coil comprises at least a first conductor layer and a second conductor layer, wherein each of the first and second conductor layers comprises one or more disc windings and wherein the first conductor layer is disposed radially inward from the second conductor layer.

The transformer 10 is a distribution transformer and has a kVA rating in a range of from about 112.5 kVA to about 15,000 kVA. The voltage of the high voltage coil is in a range of from about 600 V to about 35 kV and the voltage of the low voltage coil is in a range of from about 120 V to about 15 kV.

Although the transformer 10 is shown and described as being a three phase distribution transformer, it should be appreciated that the present invention is not limited to three phase transformers or distribution transformers. The present invention may utilized in single phase transformers and transformers other than distribution transformers.

Figure 2:
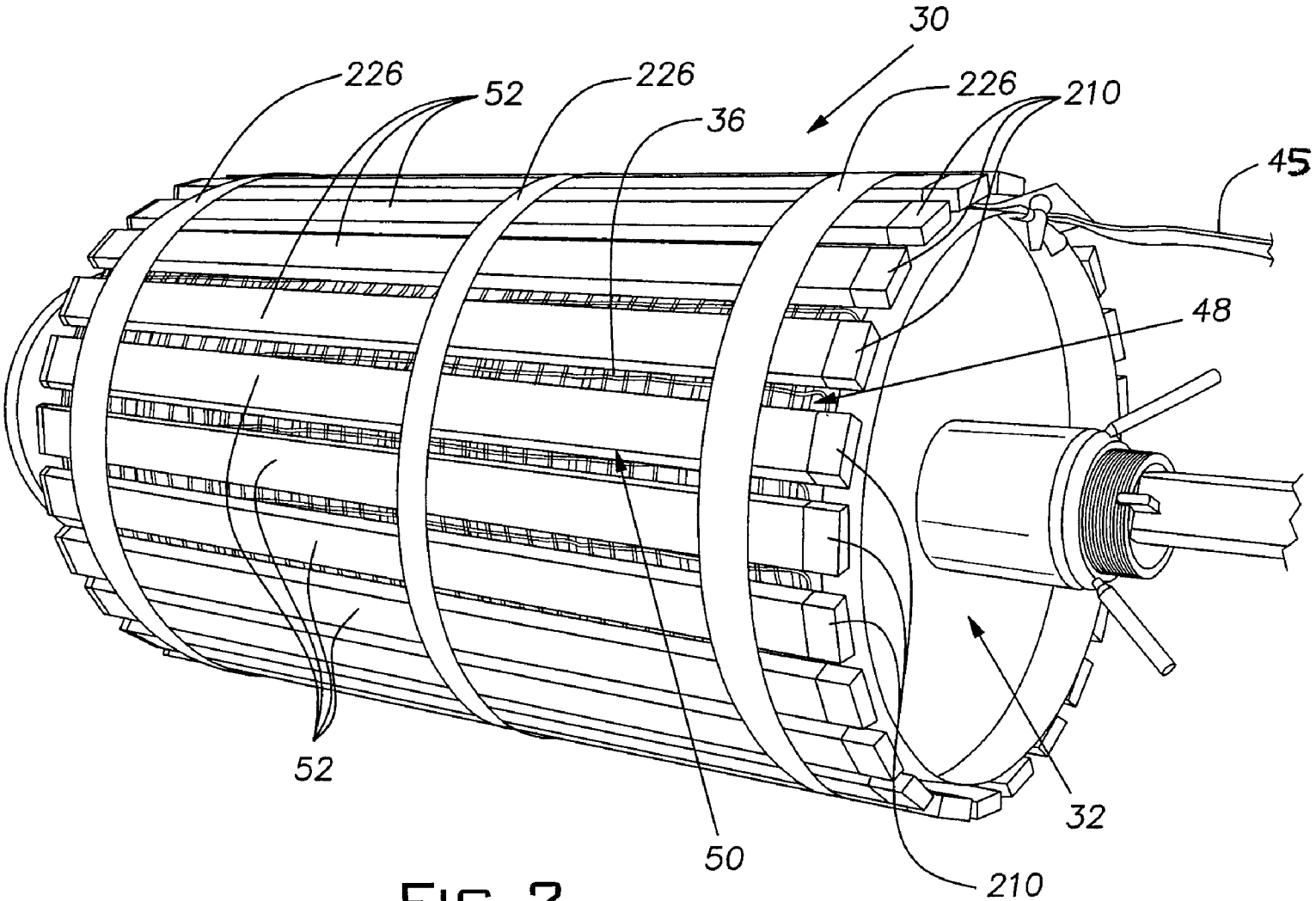
FIG. 2 shows a side perspective view of a coil of the transformer being formed on a winding mandrel.
Figure 3:
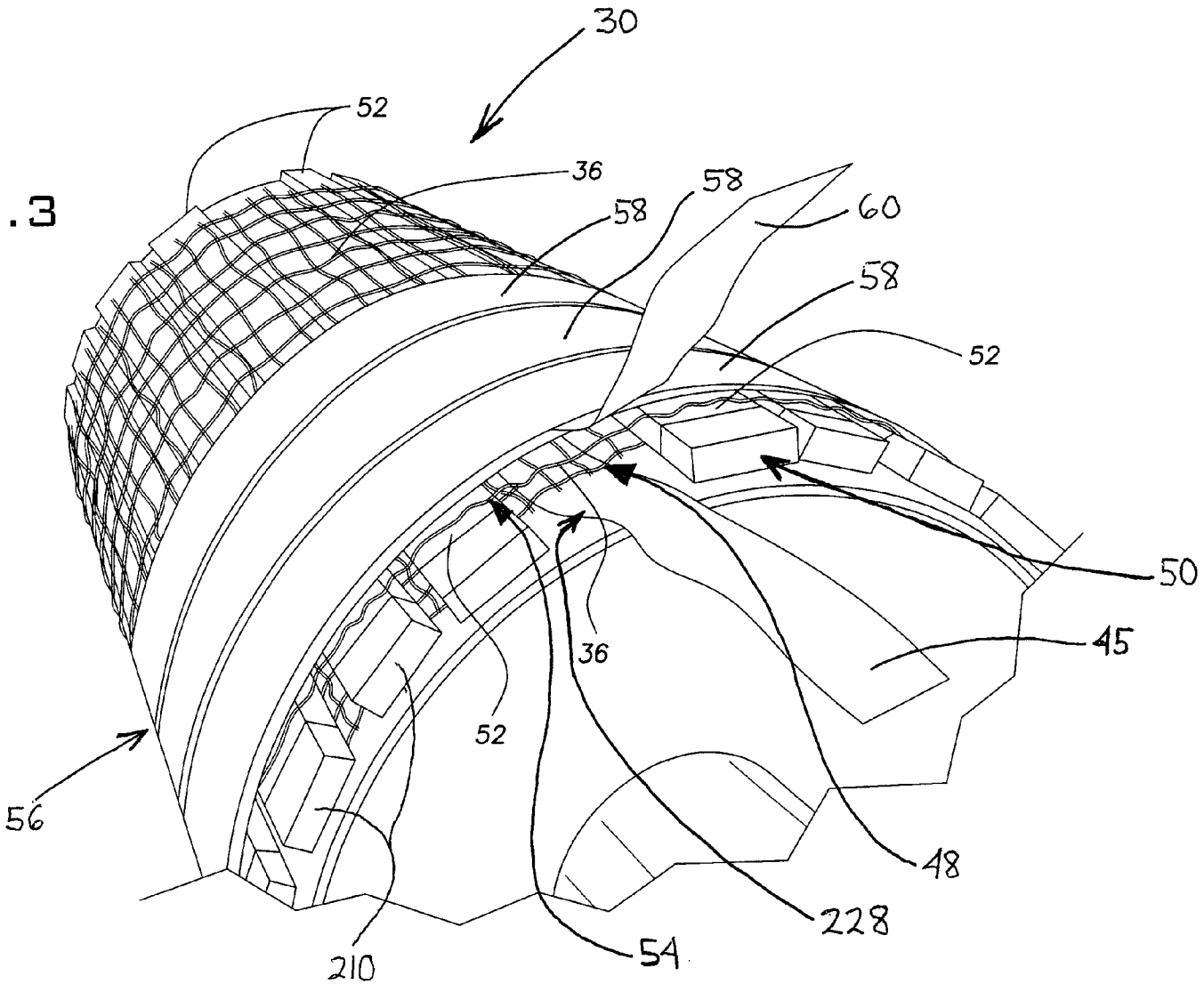
FIG. 3 shows an end perspective view of a portion of the coil being formed on the mandrel.
Figure 4:
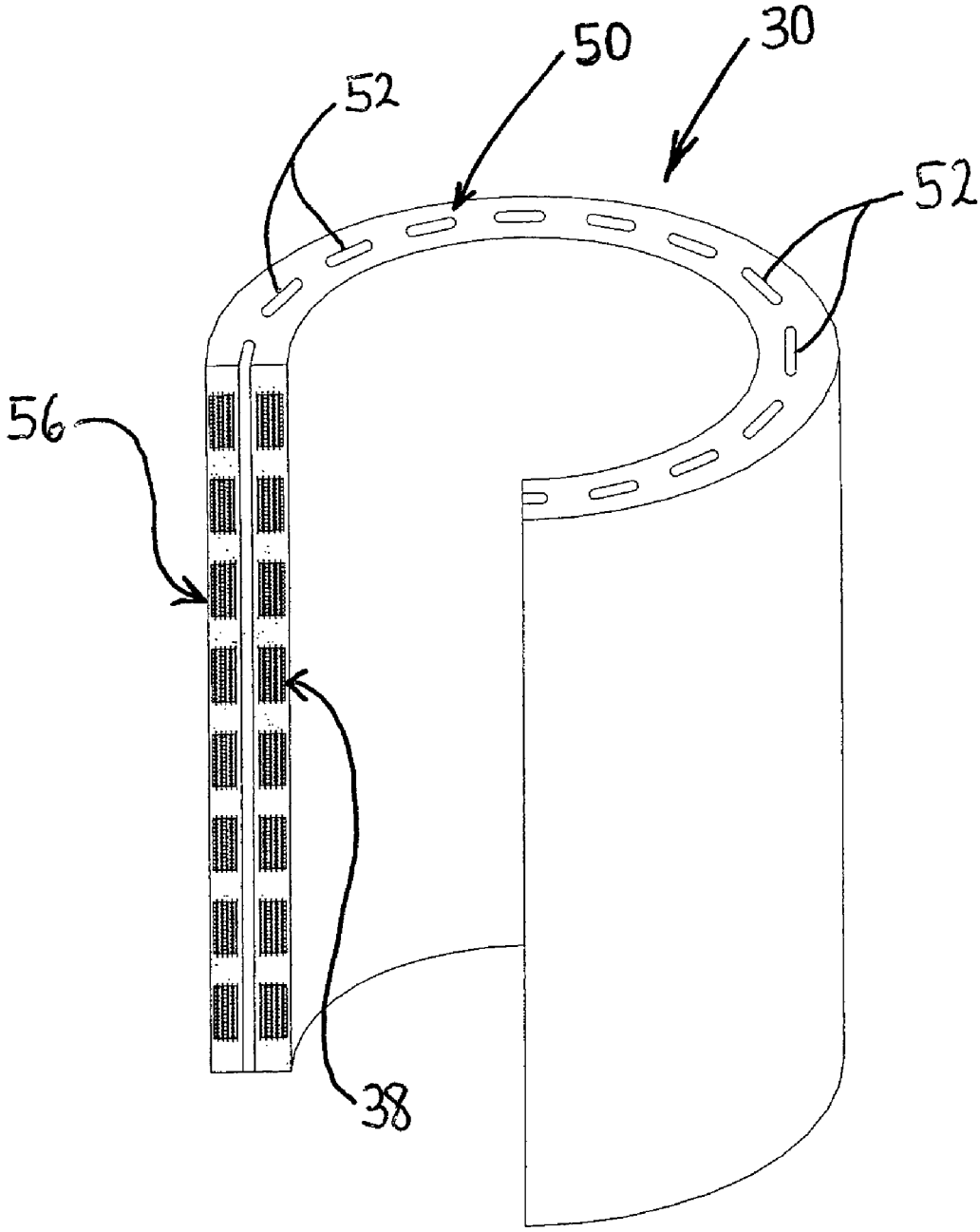
FIG. 4 shows a perspective view of the coil when fully constructed, with a portion of the coil cut away to show a cross-section of a portion of the coil.
Figure 5:
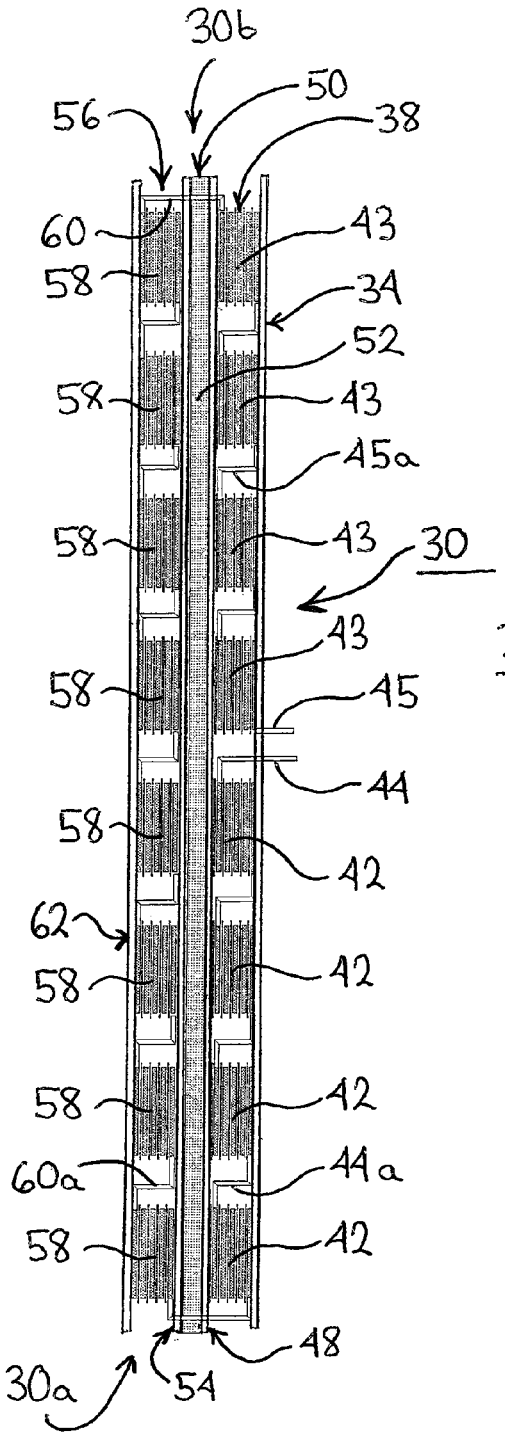
FIG. 5 shows an enlarged view of a portion of the cross-section of the coil shown in FIG. 4 wherein the coil has disc windings with drop-downs.
Figure 6:
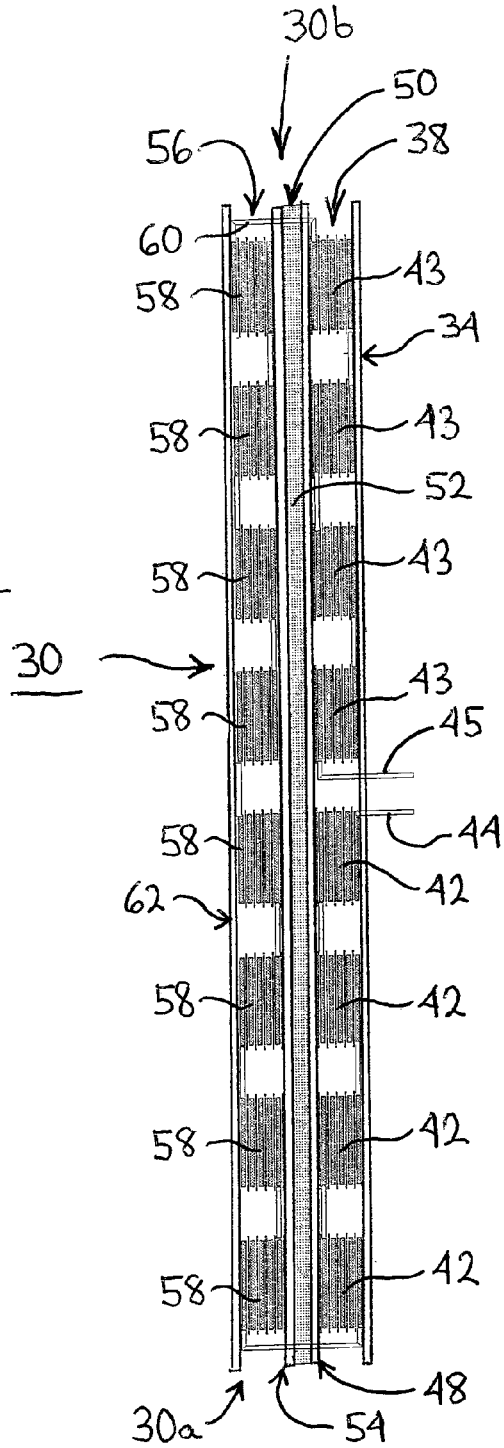
FIG. 6 shows an enlarged view of a portion of the cross-section of the coil shown in FIG. 4 wherein the coil has disc windings that are continuously wound.

FIGS. 2, 3, 4, 5 and 6 show a high voltage coil 30 constructed in accordance with the present invention. FIGS. 2 and 3 show the coil 30 being formed on a winding mandrel 32. FIG. 4 shows a perspective view of the coil 30 when fully constructed, with a portion of the coil 30 cut away to show a cross-section of the coil 30. Enlarged views of portions of the cross-section are shown in FIGS. 5 and 6. The coil 30 may be used in the transformer 10.

Initially, a first insulating layer 34 (shown in FIGS. 5 and 6) is disposed over the winding mandrel 32. The first insulating layer 34 comprises a sheet or web of screen material 36, which is comprised of glass fibers woven into a grid with rectangular openings. More specifically, the screen material 36 has spaced-apart longitudinally arranged glass fibers that adjoin spaced-apart laterally arranged glass fibers at intersections that form the corners of the rectangular openings. The glass fibers may be impregnated with an insulating resin, such as an epoxy. A mound or button of insulating material is joined to each intersection and protrudes above the web and may also protrude below the web. The buttons have a rounded shape and may be formed by building up the insulating resin at the intersections. The screen material 36 may have the construction and arrangement of the screen material disclosed in U.S. patent application Ser. No. 10/858,039 (Publication No. 2005/0275496), which is assigned to ABB Technology Inc. and is hereby incorporated by reference. The web of screen material 36 is wound around the winding mandrel 32 to form a cylinder and opposing longitudinal edges of the web are held together, at least temporarily with a glass fiber tape.

A first conductor layer 38 is formed over the first insulating layer 34. The glass fiber tape holding the first insulating layer 34 together may be removed as the first conductor layer 38 is being formed, or the glass fiber tape may be left in place. The first conductor layer 38 comprises a first group of disc windings 42 and a second group of disc windings 43 that are not directly connected together. In the first group of disc windings 42, the disc windings 42 are all connected together in a serial arrangement, and in the second group of disc windings 43, the disc windings 43 are all connected together in a serial arrangement. The first group of disc windings 42 is formed with a conductor 44 and the second group of disc windings 43 is formed with a conductor 45. Both the first group of disc windings 42 and the second group of disc windings 45 begin at the center of the coil 30.

Each conductor 44, 45 is composed of a metal such as copper or aluminum. Each conductor 44, 45 may be in the form of a wire and may have a rectangular cross-section. Alternately, each conductor 44, 45 may be in the form of a foil, wherein the conductor 44, 45 is thin and rectangular, with a width as wide as the disc winding it forms. In the embodiments shown and described with regard to FIGS. 2-10, it has been found particularly useful to use foil conductors, more specifically foil conductors having a width to thickness ratio of greater than 20:1, more particularly from about 250:1 to about 25:1, more particularly from about 200:1 to about 50:1, still more particularly about 150:1. In one particular embodiment, the foil conductor is between about 0.008 to about 0.02 inches thick and between about 1 and 2 inches wide, more particularly about 0.01 inches thick and about 1.5 inches wide. In each disc winding 42, 43, the turns of the conductor 44, 45 are wound in a radial direction, one on top of the other, i.e., one turn per layer. An insulating layer is disposed between each layer or turn of the conductor 44, 45. The insulating layer may be comprised of a polyimide film, such as is sold under the trademark Nomex®; a polyamide film, such as is sold under the trademark Kapton®, or a polyester film, such as is sold under the trademark Mylar®.

In forming the disc windings 42, 43, the conductors 44, 45 can be continuously wound (as shown in FIG. 6) or may be provided with "drop-downs" 44*a*, 45*a*, respectively (as shown in FIG. 5). If each conductor 44, 45 is continuously wound, the conductor 44, 45 is wound in alternating directions, i.e., inside to outside and then outside to inside, etc. If the conductor 44, 45 is provided with drop-downs 44*a*, 45*a* the conductor 44, 45 is wound in one direction, i.e., inside to outside. A drop-down 44*a*, 45*a* is a bend that is formed at the completion of a disc winding 42, 43 to bring the conductor 44, 45 from the outside back to the inside to begin a subsequent disc winding 42, 43. If the thickness of the conductor 44, 45 permits drop-downs 44*a*, 45*a* to be formed without too much difficulty, the use of drop-downs is preferred. Although not shown, the conductors 44, 45 are welded to coil leads that are disposed radially inward from the first conductor layer 38 and extend to one end of the coil 30. The coil leads are provided for connection to a source of voltage.

After the first conductor layer 38 has been formed, a second insulating layer 48 comprised of a sheet or web of the screen material 36 is formed over the first conductor layer 38. Next, a layer 50 of cooling ducts 52 is disposed over the second insulating layer 48, as will be described more fully below. A third insulating layer 54 comprised of a sheet or web of the screen material 36 is then formed over the layer of cooling ducts 52. In lieu of forming a layer of cooling ducts 52, additional insulating layers comprised of the screen material 36 or other insulating material may be disposed over the second insulating layer 48. Still another option is to form a second conductor layer 56 directly over the second insulating layer 48.

The second conductor layer 56 is formed from a conductor 60, which is electrically connected to the conductors 44, 45 of the first conductor layer 38, or is an integral part of the conductor 44, or is an integral part of the conductor 45, or is partially an integral part of the conductor 44 and partially an integral part of the conductor 45. The conductors 44, 45 may be passed through the second insulating layer 48, the layer of cooling ducts 52 and the third insulating layer 54 to reach the second conductor layer 56. The second conductor layer 56 comprises a plurality of disc windings 58 and is formed over the third insulating layer 54 (if the layer of cooling ducts 52 is formed), or over the additional insulating layers, or directly over the second insulating layer 48. The number of disc windings 58 in the second conductor layer 56 is the same as the total number of disc windings 42, 43 in the first conductor layer 38. The disc windings 58 in the second conductor layer 56 are all connected together in a serial arrangement. If the conductor 60 is an integral part of the conductor 44, the disc windings 58 are formed beginning at a first end 30*a* of the coil 30 and continuing to a second end 30*b* of the coil 30, where the conductor 60 is electrically connected to the conductor 45. If the conductor 60 is an integral part of the conductor 45, the disc windings 58 are formed beginning at a second end 30*b* of the coil 30 and continuing to the first end 30*a* of the coil 30, where the conductor 60 is electrically connected to the conductor 44. If the conductor 60 is partially an integral part of the conductor 44 and partially an integral part of the conductor 45, the disc windings 58 may be formed beginning at both the first and second ends 30*a*, 30*b* of the coil 30 and continuing to the axial center of the coil 30, where the two parts of the conductor 60 are electrically connected together. Once again, an insulating layer is disposed between each layer or turn of the conductor 60. The insulating layer may be comprised of a polyimide film, such as is sold under the trademark Nomex®; a polyamide film, such as is sold under the trademark Kapton®, or a polyester film, such as is sold under the trademark Mylar®. Also, the conductor 60 can be continuously wound (as shown in FIG. 6) or may be provided with drop-downs 60*a* (as shown in FIG. 5).

After the second conductor layer 56 has been formed, a fourth insulating layer 62 comprised of a sheet or web of the screen material 36 is formed over the second conductor layer 56. The coil 30 is then ready to be impregnated with an insulating resin 64, which is described in more detail below.

When the disc windings 42, 43 are formed between the first and second insulating layers 34, 48, as described above, the disc windings 42, 43 are held between the buttons of the screen material 36 that forms the first and second insulating layers 34, 48 so as to form insulation gaps between the disc windings 42, 43 and the grids of the screen material 36 disposed on opposing sides of the disc windings 42, 43. Such insulation gaps are also formed on the opposing sides of the disc windings 58 and the cooling ducts 52 in the coil 30, as well as on opposing sides of disc windings and cooling ducts in other coils to be described below. Such insulation gaps are filled by the insulating resin 64 during the encapsulation of the coils with the insulating resin 64.

Figure 7:
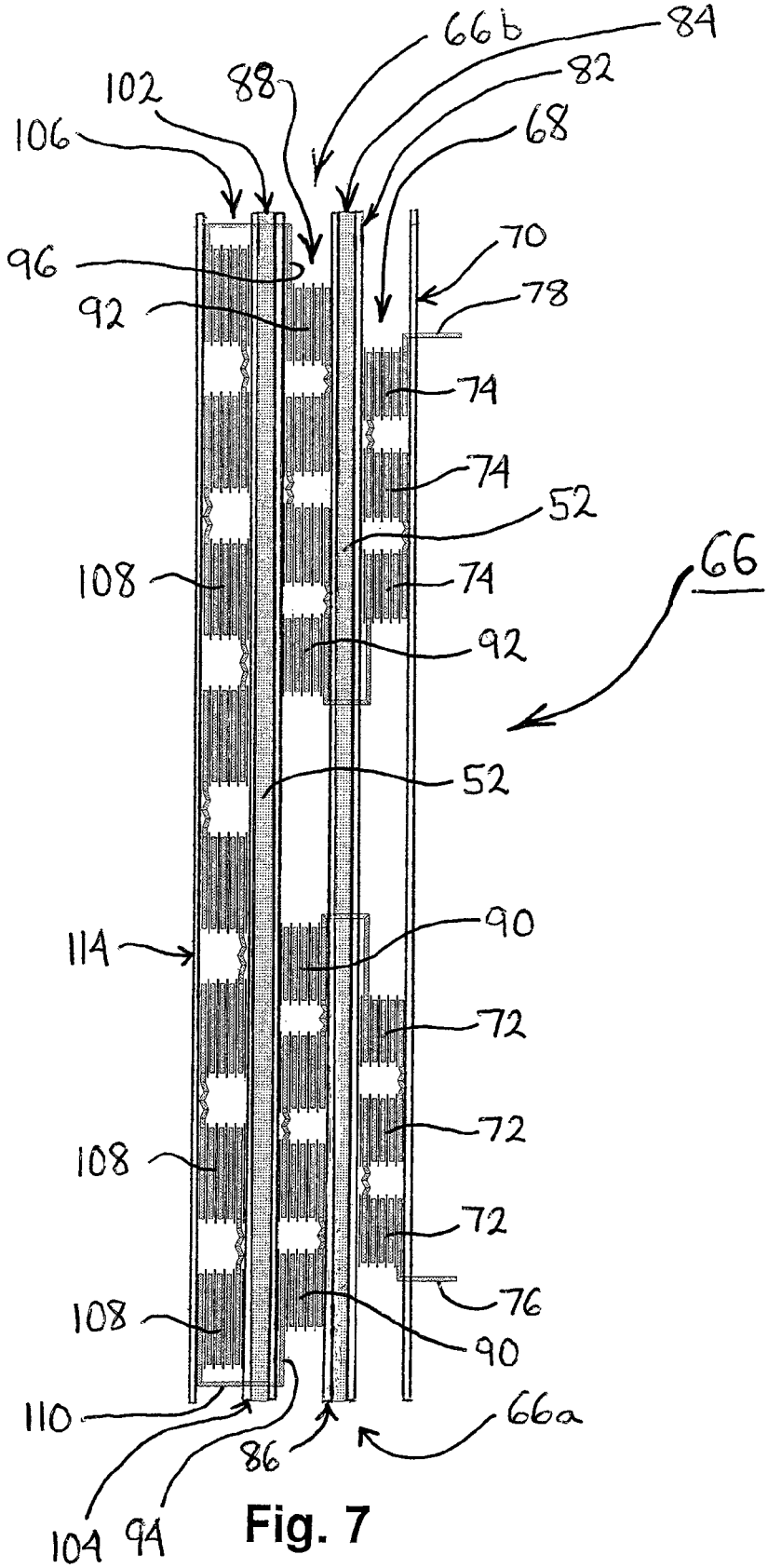
FIG. 7 shows an enlarged view of a portion of a cross-section of a coil embodied in accordance with a second embodiment of the present invention.

Referring now to FIG. 7, there is shown a sectional view of a high voltage coil 66 constructed in accordance with a second embodiment of the present invention. The coil 66 may be used in the transformer 10. In the coil 66, a first conductor layer 68 is formed over a first insulating layer 70 comprised of the screen material 36. The first conductor layer 68 comprises a first group of disc windings 72 and a second group of disc windings 74 that are not directly connected together. In the first group of disc windings 72, the disc windings 72 are all connected together in a serial arrangement, and in the second group of disc windings 74, the disc windings 74 are all connected together in a serial arrangement. The first group of disc windings 72 is formed with a first conductor 76 and the second group of disc windings 74 is formed with a second conductor 78. Although not shown, the first and second conductors 76, 78 are welded to coil leads that are disposed radially inward from the first conductor layer 68 and extend to one end of the coil 66. The coil leads are provided for connection to a source of voltage.

The first group of disc windings 72 begins at a first end 66*a* of the coil 66, while the second group of disc windings 74 begins at a second end 66*b* of the coil 66. In forming the disc windings 72, the first conductor 76 can be continuously wound (as shown) or may be provided with drop-downs, and an insulating layer is disposed between each layer or turn of the first conductor 76. Similarly, in forming the disc windings 74, the second conductor 78 can be continuously wound (as shown) or may be provided with drop-downs, and an insulating layer is disposed between each layer or turn of the second conductor 78. The insulating layers in the disc windings 72, 74 may be comprised of a polyimide film, such as is sold under the trademark Nomex®; a polyamide film, such as is sold under the trademark Kapton®, or a polyester film, such as is sold under the trademark Mylar®.

After the first conductor layer 68 has been formed, a second insulating layer 82 comprised of a sheet or web of the screen material 36 is formed over the first conductor layer 68. Next, a first layer 84 of the cooling ducts 52 is disposed over the second insulating layer 82, as will be described more fully below. A third insulating layer 86 comprised of a sheet or web of the screen material 36 is then formed over the first layer 84 of the cooling ducts 52. In lieu of forming the first layer 84 of the cooling ducts 52, additional insulating layers comprised of the screen material 36 or other insulating material may be disposed over the second insulating layer 82.

A second conductor layer 88 is formed over the third insulating layer 86 (if the first layer 84 of the cooling ducts 52 is formed), or over the additional insulating layers, or directly over the second insulating layer 82. Similar to the first conductor layer 68, the second conductor layer 88 comprises a first group of disc windings 90 and a second group of disc windings 92 that are not directly connected together. Instead of having three disc windings per group, however, the second conductor layer 88 has four disc windings per group, i.e., four disc windings 90 and four disc windings 92. In the first group of disc windings 90, the disc windings 90 are all connected together in a serial arrangement, and in the second group of disc windings 92, the disc windings 92 are all connected in a serial arrangement. The first group of disc windings 90 is formed from a first conductor 94, which is electrically connected to, or is an integral part of, the first conductor 76 of the first conductor layer 68. Similarly, the second group of disc windings 92 is formed from a second conductor 96, which is electrically connected to, or is an integral part of, the second conductor 78 of the first conductor layer 68. The first and second conductors 76, 78 may be passed through the second insulating layer 83, the first layer 84 of the cooling ducts 52 and the third insulating layer 86 to reach the second conductor layer 88. Both the first and second groups of disc windings 90, 92 begin in a middle portion of the coil 66 and proceed axially outward, respectively. In forming the disc windings 90, the first conductor 94 can be continuously wound (as shown) or may be provided with drop-downs, and an insulating layer is disposed between each layer or turn of the first conductor 94. Similarly, in forming the disc windings 92, the second conductor 96 can be continuously wound (as shown) or may be provided with drop-downs, and an insulating layer is disposed between each layer or turn of the second conductor 96. The insulating layers in the disc windings 90, 92 may be comprised of a polyimide film, such as is sold under the trademark Nomex®; a polyamide film, such as is sold under the trademark Kapton®, or a polyester film, such as is sold under the trademark Mylar®.

After the second conductor layer 88 has been formed, a fourth insulating layer 100 comprised of a sheet or web of the screen material 36 is formed over the second conductor layer 88. Next, a second layer 102 of cooling ducts 52 may be disposed over the fourth insulating layer 100, as will be described more fully below. A fifth insulating layer 104 comprised of a sheet or web of the screen material 36 is then formed over the second layer 102 of cooling ducts 52. In lieu of forming the second layer 102 of cooling ducts 52, additional insulating layers comprised of the screen material 36 or other insulating material may be disposed over the fourth insulating layer 100.

A third conductor layer 106 is formed over the fifth insulating layer 104 (if the second layer 102 of cooling ducts 52 is formed), or over the additional insulating layers, or directly over the fourth insulating layer 100. The third conductor layer 106 comprises a single group of disc windings 108, all of which are connected together in a serial arrangement. The number of disc windings 108 in the third conductor layer 106 is the same as the total number of the disc windings 90, 92 in the second conductor layer 88. The third conductor layer 106 is formed from a conductor 110, which is electrically connected to the first and second conductors 94, 96 of the second conductor layer 88, or is an integral part of the first conductor 94, or an integral part of the second conductor 96, or is partially an integral part of the first conductor 94 and partially an integral part of the second conductor 96. The first conductor 94 and the second conductor 96 may be passed through the fourth insulating layer, the second layer of cooling ducts 52 and the fifth insulating layer (if they are provided) to reach the third conductor layer 106. If the conductor 110 is an integral part of the first conductor 94, the disc windings 108 are formed beginning at the first end 66*a* of the coil 66 and continuing to the second end 66*b* of the coil 66, where the conductor 110 is electrically connected to the second conductor 96. If the conductor 110 is an integral part of the second conductor 94, the disc windings 108 are formed beginning at the second end 66*b* of the coil 66 and continuing to the first end 66*a* of the coil 66, where the conductor 110 is electrically connected to the first conductor 94. If the conductor 110 is partially an integral part of the first conductor 94 and partially an integral part of the second conductor 96, the disc windings 108 may be formed beginning at both the first and second ends 66*a*, 66*b* of the coil 66 and continuing to the axial center of the coil 66 where the two parts of the conductor 110 are electrically connected together. In forming the disc windings 108, the conductor 110 can be continuously wound (as shown) or may be provided with drop-downs, and an insulating layer is disposed between each layer or turn of the conductor 110. The insulating layer may be comprised of a polyimide film, such as is sold under the trademark Nomex®; a polyamide film, such as is sold under the trademark Kapton®, or a polyester film, such as is sold under the trademark Mylar®.

After the third conductor layer 106 has been formed, a sixth insulating layer 114 comprised of a sheet or web of the screen material 36 is formed over the third conductor layer 106. The coil 66 is then ready to be impregnated with the insulating resin 64, as will be described in more detail below.

Figure 8:
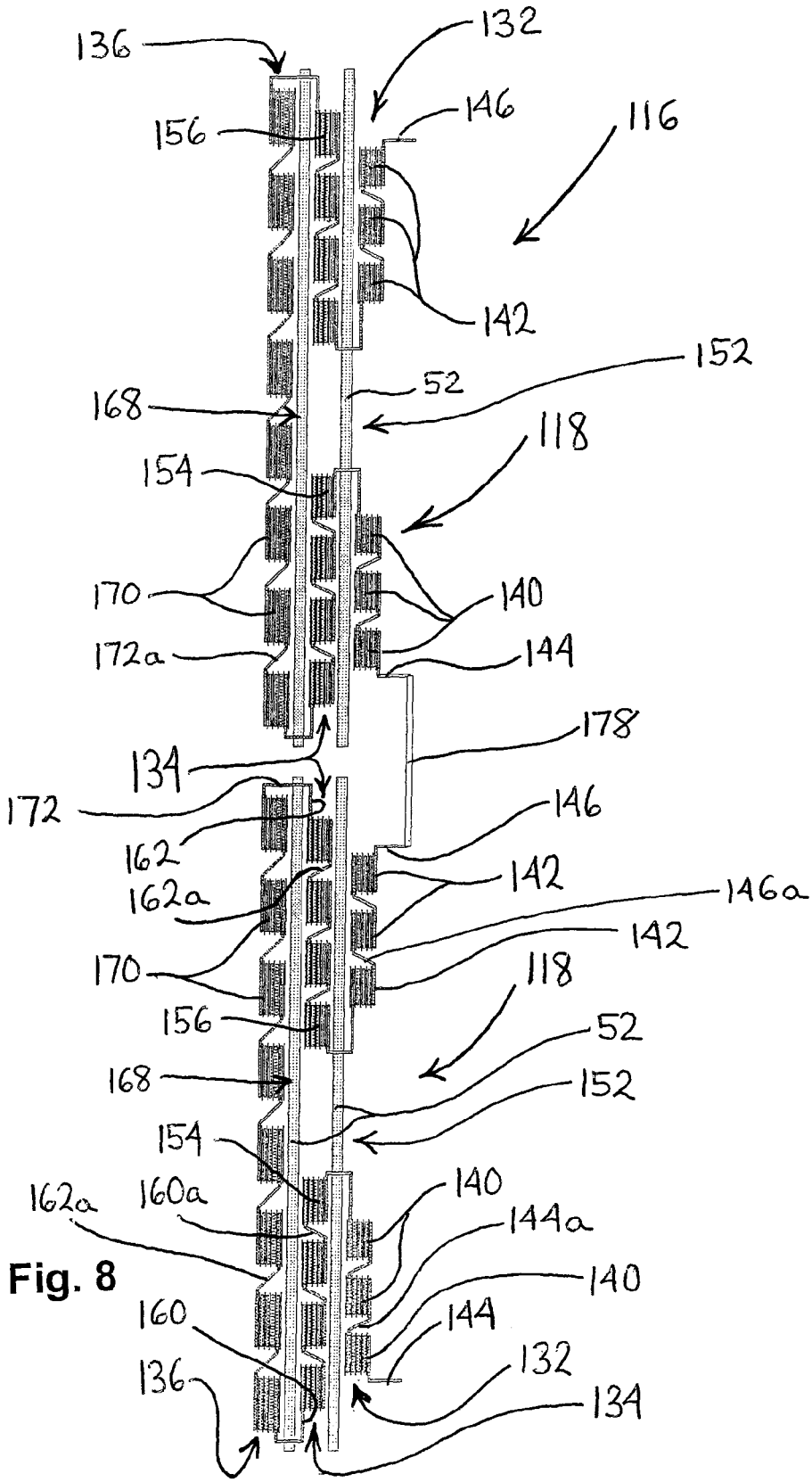
FIG. 8 shows an enlarged view of a portion of a cross-section of a coil embodied in accordance with a third embodiment of the present invention.

Referring now to FIG. 8, there is shown a sectional view of a high voltage coil 116, which may be used in the transformer 10 and which is constructed in accordance with a third embodiment of the present invention. The coil 116 comprises a pair of axially arranged sections 118, which have substantially the same construction. Accordingly, only one of the sections 118 will be described for purposes of brevity. Each section 118 comprises first, second, third, fourth, fifth and sixth insulating layers, which are not shown for purposes of clarity, and first, second, and third conductor layers 132, 134, 136. Each of the first through sixth insulating layers is comprised of the screen material 36. The first conductor layer 132 is formed over the first insulating layer and comprises a first group of disc windings 140 and a second group of disc windings 142 that are not directly connected together. In the first group of disc windings 140, the disc windings 140 are all connected together in a serial arrangement, and in the second group of disc windings 142, the disc windings 142 are all connected together in a serial arrangement. The first group of disc windings 140 is formed with a first conductor 144 and the second group of disc windings 142 is formed with a second conductor 146. Although not shown, the first and second conductors 144, 146 are welded to coil leads that are disposed radially inward from the first conductor layer 132 and extend to one end of the coil 116. The coil leads are provided for connection to a source of voltage.

In forming the disc windings 140, the first conductor 144 may be provided with drop-downs 144*a* (as shown), or may be continuously wound, and an insulating layer is disposed between each layer or turn of the first conductor 144. Similarly, in forming the disc windings 142 the second conductor 146 may be provided with drop-downs 146*a* (as shown) or, may be continuously wound, and an insulating layer is disposed between each layer or turn of the second conductor 146. The insulating layers in the disc windings 140, 142 may be comprised of a polyimide film, such as is sold under the trademark Nomex®; a polyamide film, such as is sold under the trademark Kapton®, or a polyester film, such as is sold under the trademark Mylar®.

After the first conductor layer 132 has been formed, the second insulating layer is formed over the first conductor layer 132. Next, a first layer 152 of cooling ducts 52 is disposed over the second insulating layer 122. The third insulating layer is then formed over the first layer 152 of the cooling ducts 52. In lieu of forming the first layer 152 of cooling ducts 52, additional insulating layers comprised of the screen material 36 or other insulating material may be disposed over the second insulating layer.

The second conductor layer 134 is formed over the third insulating layer (if the first layer 152 of cooling ducts 52 is formed), or over the additional insulating layers, or directly over the second insulating layer. Similar to the first conductor layer 132, the second conductor layer comprises a first group of disc windings 154 and a second group of disc windings 156 that are not directly connected together. Instead of having three disc windings per group, however, the second conductor layer 134 has four disc windings per group, i.e., four disc windings 154 and four disc windings 156. In the first group of disc windings 154, the disc windings 154 are all connected together in a serial arrangement, and in the second group of disc windings 156, the disc windings 156 are all connected in a serial arrangement. The first group of disc windings 154 is formed from a first conductor 160, which is electrically connected to, or is an integral part of, the first conductor 144 of the first conductor layer 132. Similarly, the second group of disc windings 156 is formed from a second conductor 162, which is electrically connected to, or is an integral part of, the second conductor 146 of the first conductor layer 132. The first and second conductors 160, 162 may be passed through the second insulating layer, the first layer 152 of the cooling ducts 52 and the third insulating layer to reach the second conductor layer 134. In forming the disc windings 154, the first conductor 160 may be provided with drop-downs 160*a* (as shown), or can be continuously wound, and an insulating layer is disposed between each layer or turn of the first conductor 160. Similarly, in forming the disc windings 156, the second conductor 162 may be provided with drop-downs 162*a* (as shown), or can be continuously wound, and an insulating layer is disposed between each layer or turn of the second conductor 162. The insulating layers in the disc windings 154, 156 may be comprised of a polyimide film, such as is sold under the trademark Nomex®; a polyamide film, such as is sold under the trademark Kapton®, or a polyester film, such as is sold under the trademark Mylar®.

After the second conductor layer 134 has been formed, the fourth insulating layer is formed over the second conductor layer 134. Next, a second layer 168 of cooling ducts 52 may be disposed over the fourth insulating layer. The fifth insulating layer is then formed over the second layer 168 of cooling ducts 52. In lieu of forming the second layer 168 of cooling ducts 52, additional insulating layers comprised of the screen material 36 or other insulating material may be disposed over the fourth insulating layer.

The third conductor layer 136 is formed over the fifth insulating layer (if the second layer 168 of cooling ducts 52 is formed), or over the additional insulating layers, or directly over the fourth insulating layer. The third conductor layer 136 comprises a single group of disc windings 170, all of which are connected together in a serial arrangement. The number of disc windings 170 in the third conductor layer 136 is the same as the total number of the disc windings 154, 156 in the second conductor layer 134. The third conductor layer 136 is formed from a conductor 172, which is electrically connected to the first and second conductors 160, 162 of the second conductor layer 134, or is an integral part of the first conductor 160, or is an integral part of the second conductor 162, or is partially an integral part of the first conductor 160 and partially an integral part of the second conductor 162. The first conductor 160 and the second conductor 162 may be passed through the fourth insulating layer, the second layer 168 of cooling ducts 52 and the fifth insulating layer (if they are provided) to reach the third conductor layer 136. In forming the disc windings 170, the conductor 172 may be provided with drop-downs 172*a* (as shown), or can be continuously wound, and an insulating layer is disposed between each layer or turn of the conductor 172. The insulating layer may be comprised of a polyimide film, such as is sold under the trademark Nomex®; a polyamide film, such as is sold under the trademark Kapton®, or a polyester film, such as is sold under the trademark Mylar®.

After the third conductor layer 136 has been formed, the sixth insulating layer is formed over the third conductor layer 136.

The sections 118 are serially disposed along a longitudinal axis of the coil 116 and are electrically connected together by a conductor 178 having a first end secured to the second conductor 146 of a lower one of the sections 118 and a second end secured to the first conductor 144 of an upper one of the sections 118. The sections 118 are connected together during the formation of the first conductor layers 132 of the sections 118. Once the sections 118 are completed, the sections 118 and the rest of the coil 116 are impregnated with the insulating resin 64.

Figure 9:
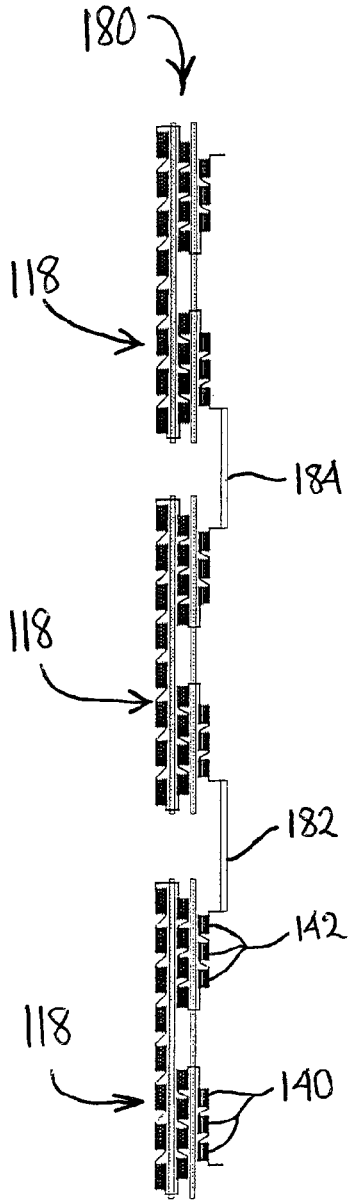
FIG. 9 shows an enlarged view of a portion of a cross-section of a coil embodied in accordance with a fourth embodiment of the present invention.

Other coils may be provided with different numbers of sections 118. For example, FIG. 9 shows a high voltage coil 180 having three sections 118 serially disposed along a longitudinal axis of the coil 180. A lower one of the sections 118 and a middle one of the sections 118 are electrically connected together by a conductor 182 having a first end secured to the second conductor 146 of the lower one of the sections 118 and a second end secured to the first conductor 144 of the middle one of the sections 118. The middle one of the sections 118 and an upper one of the sections 118 are electrically connected together by a conductor 184 having a first end secured to the second conductor 146 of the middle one of the sections 118 and a second end secured to the first conductor 144 of the upper one of the sections 118. The coil 180 may be used in the transformer 10.

Figure 10:
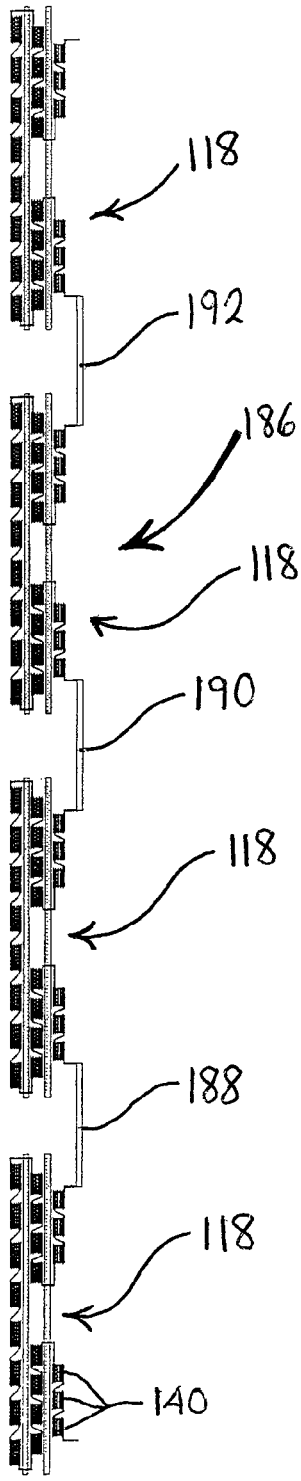
FIG. 10 shows an enlarged view of a portion of a cross-section of a coil embodied in accordance with a fifth embodiment of the present invention.

Referring now to FIG. 10, there is shown a high voltage coil 186 having four sections 118 spaced apart along a longitudinal axis of the coil 186. A lower one of the sections 118 and a lower middle one of the sections 118 are electrically connected together by a conductor 188 having a first end secured to the second conductor 146 of the lower one of the sections 118 and a second end secured to the first conductor 144 of the lower middle one of the sections 118. The lower middle one of the sections 118 and an upper middle one of the sections 118 are electrically connected together by a conductor 190 having a first end secured to the second conductor 146 of the lower middle one of the sections 118 and a second end secured to the first conductor 114 of the upper middle one of the sections 118. The upper middle one of the sections 118 and an upper one of the sections 118 are electrically connected together by a conductor 192 having a first end secured to the second conductor 146 of the upper middle one of the sections 118 and a second end secured to the first conductor 144 of the upper one of the sections 118. The coil 186 may be used in the transformer 10.

In both the coil 180 and the coil 186, the sections 118 are connected together during the formation of the first conductor layers 132 of the sections 118.

In FIGS. 8, 9 and 10, the sections 118 and, thus, the first and second layers 152, 168 of cooling ducts 52 and the first through sixth insulating layers of the sections 118 are shown being spaced apart. It should be appreciated, however, that the sections 118 can be disposed such that the first and second layers 152, 168 of cooling ducts 52 and the first through sixth insulating layers of the sections 118 abut each other. It should further be appreciated that in lieu of the sections 118 having separate first and second layers 152, 168 of cooling ducts 52 and separate first through sixth insulating layers, the sections 118 may share the first and second layers 152, 168 of cooling ducts 52 and the first through sixth insulating layers. In this manner, in each coil 116, 180, 186, the cooling ducts 52 in the first and second layers 152, 168 and the first through sixth insulating layers would extend uninterrupted between first and second ends of the coil 116, 180, 186.

In the coils 30, 66, 116, 180, 186 described above, the greatest number of conductor layers disclosed is three and the greatest number of layers of cooling ducts 52 disclosed is two. It should be appreciated, however, that the present invention is not limited to three conductor layers and two layers of cooling ducts 52. A greater number of conductor layers, such as four, five, or six may be provided, and a greater number of layers of cooling ducts 52, such as three, four, or five may be provided.

Figure 11:
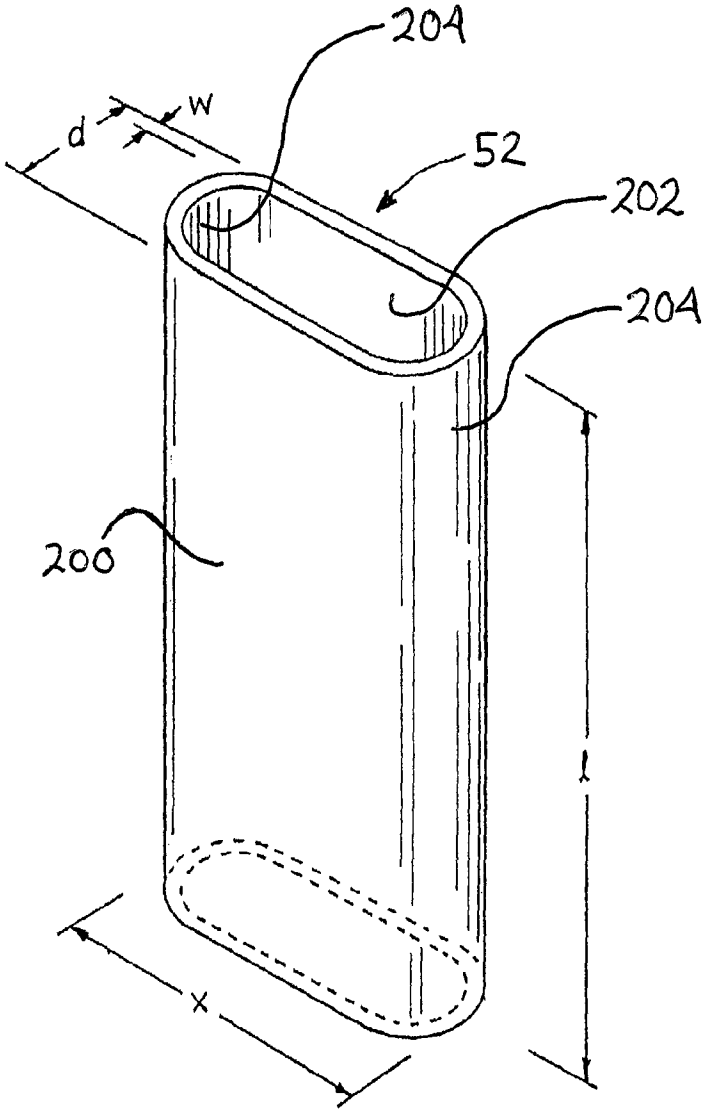
FIG. 11 shows a front perspective view of a cooling duct mounted in a coil embodied in accordance with the present invention.
Figure 12:
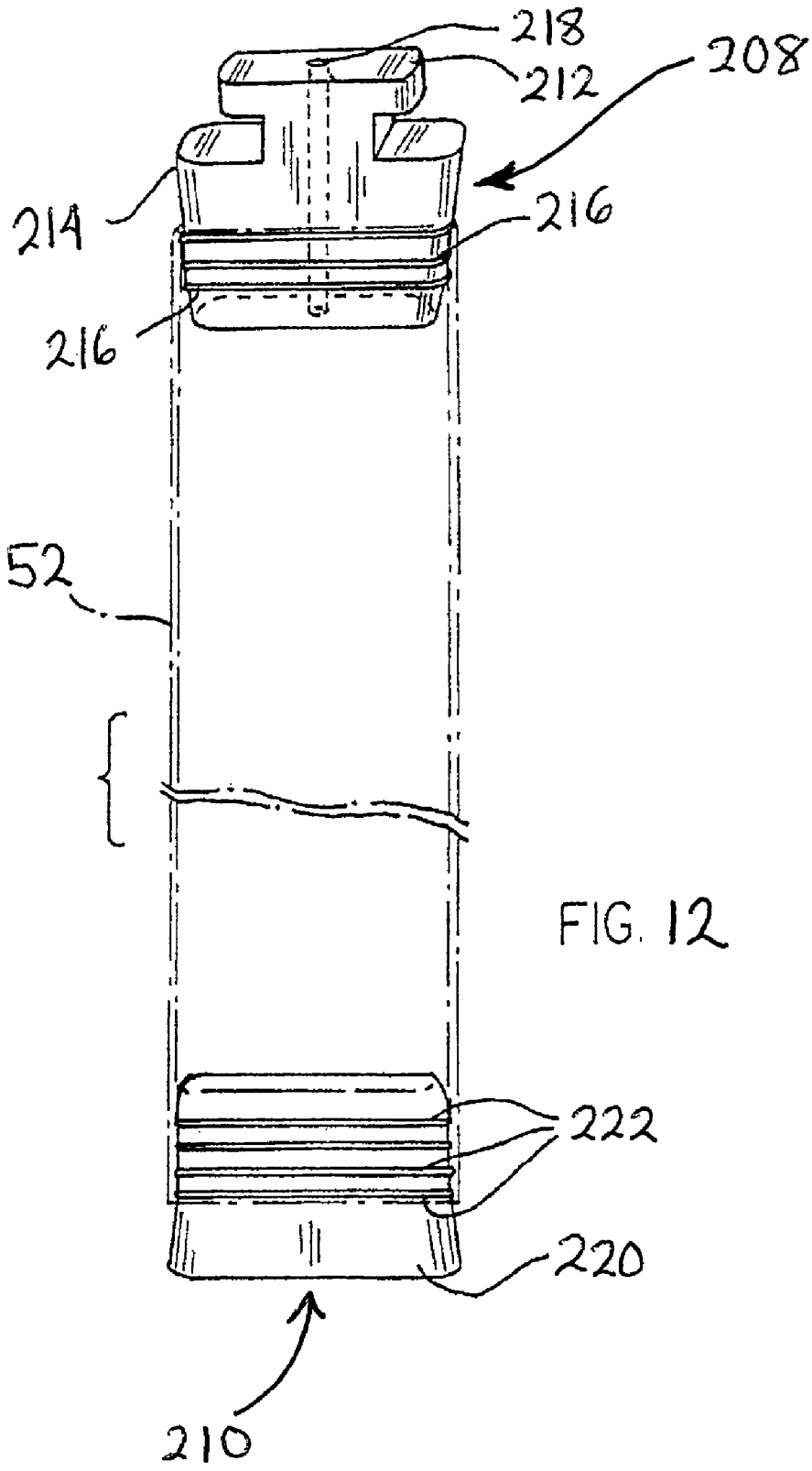
FIG. 12 shows a perspective view of plugs for temporary insertion in the cooling duct.

Referring now to FIGS. 11 and 12, there is shown one of the cooling ducts 52 used in the coils 30, 66, 116, 180, 186. Each cooling duct 52 has a generally elliptical cross-section, with open ends and spaced-apart generally planar front and rear walls 200, 202 joined together by a pair of spaced-apart curved side walls 204. It has been found particularly useful to provide each cooling duct 52 with a linear dimension, x, that is about three times the width, d, of the cooling duct 52. Each cooling duct 52 is constructed to withstand a vacuum of at least one millibar during the resin encapsulation process described below.

Each cooling duct 52 is comprised of a fiber reinforced plastic in which fibers, such as fiberglass fibers, are impregnated with a thermoset resin, such as a polyester resin, a vinyl ester resin, or an epoxy resin. It has been found particularly useful to produce the cooling ducts 52 using a pultrusion process, wherein the fibers are drawn through one or more baths of the thermoset resin and are then pulled through a heated die where the thermoset resin is cured. The fibers may be aligned as either unidirectional roving or a multi-directional mat. An example of a thermoset resin that may be used to form the cooling ducts 52 is E1586 Polyglas M, which is a polyester resin available from Resolite of Zelienople, Pa. It has been found useful to form each cooling duct 52 with an outer fiberglass reinforcing mat and an inner fiberglass reinforcing mat. The cooling ducts 52 are constructed to have certain material properties, which permit the cooling ducts 52 to be used in the coils 30, 66, 116, 180, 186. When tested in accordance with ASTM D-638, "Standard Test Method for Tensile Properties of Plastics," the cooling ducts 52 have an ultimate tensile strength of about 30,000 psi longitudinally, 6,500 psi transverse; an ultimate compressive strength of about 30,000 psi longitudinally, 10,000 psi transverse per ASTM D-695, "Standard Test Method for Compressive Properties of Rigid Plastics", and, an ultimate flexural strength, when tested in accordance with ASTM D-790, "Standard Test Method for Flexural Properties of Unreinforced and Reinforced Plastics and Electrical Insulating Materials" of about 30,000 psi longitudinally, 10,000 psi transversely. The modulus of elasticity is approximately 2.5E6 psi longitudinally per ASTM D-149, Standard Test Method for Dielectric Breakdown Voltage and Dielectric Strength of Solid Electrical Insulating Materials at Commercial Power Frequencies." Electrically, the cooling ducts 52 have an electrical strength short time (in oil), per ASTM D-149, of about 200 V/mil (perpendicular) and 35 kV/inch (parallel). It has been found particularly useful for the cooling ducts 52 to have a thermal conductivity of at least about 4 Btu/(hr*ft$^2$*° F./in).

The length of a cooling duct 52 is dependent upon the application of the cooling duct 52. For example, the cooling ducts 52 used in the sections 118 of the coils 116, 180, 186 may be shorter than the cooling ducts 52 used in the coils 30, 66. The lengths of the cooling ducts 52 are selected such that in each layer of cooling ducts 52 in a coil, the length of each single cooling duct 52 (such as in coils 30, 66), or the overall length of each axial series of cooling ducts 52 (such as in coils 116, 180, 186) is less than the overall axial length of the coil so that the opposing ends of the single cooling duct 52 or the axial series of cooling ducts 52 are enclosed within the insulating resin 64.

Each cooling duct 52 is provided with top and bottom plugs 208, 210, which are inserted into the open ends of the cooling ducts 52 to keep the insulating resin 64 from flowing into the cooling ducts 24 during the encapsulation of the coils 30, 66, 116, 180, 186 with the insulating resin 64. Each top plug 208 is dimensioned to frictionally fit within the top opening of a corresponding cooling duct 52. As used herein, the "top opening" of a cooling duct 52 in a coil is the open end of the cooling duct 52 that is at the top end of the coil from which coil leads (not shown) extend and which faces upward when the coil is being encapsulated in the insulating resin 64. The top plug 208 has a grip or handle 212 joined to a body 214. The body 214 is tapered inwardly (i.e., downwardly) and has ribs 216 around its periphery to ensure a positive seal with the inner surface of the cooling duct 52. The handle 212 and the inward taper of the body 214 facilitate the removal of the top plug 208 from the cooling duct 52 after the resin encapsulation and curing process. Since the top and bottom plugs 208, 210 will seal the ends of the cooling duct 52 during the resin encapsulation and curing process, an open passage or relief vent 218 is formed through the top plug 208 to prevent collapse of the cooling duct 52. The bottom plug 210 performs the same function as the top plug 208, except that a vacuum relief is not required and a handle is not needed. Bottom plug 210 has a body 220 with ribs 222 for frictional engagement with the inner walls of the cooling duct 52. An outer end of the body 220 of the bottom plug 210 is substantially flat so as to not interfere with the placement of a bottom end of the coil on a mat for the encapsulation of the coil in the insulating resin 64.

The formation of each layer of cooling ducts 52 in the coils 30, 66, 116, 180, 186 is similar and, thus, will be described only with regard to the layer 50 of cooling ducts 52 in the coil 30 for purposes of brevity. With reference now to FIGS. 2 and 3 again, the cooling ducts 52 extend longitudinally between the first and second ends 30*a*, 30*b* of the coil 30 and are disposed around the circumference of the partially formed coil 30, over the second insulating layer 48. The cooling ducts 52 are substantially evenly spaced apart, except for an enlarged spacing or gap 228, which permits an increased amount of insulating resin to be deposited between the second insulating layer 48 and the third insulating layer 54 during the encapsulation of the coil 30 with insulating resin. This increased amount of insulating resin helps secure the cooling ducts 52 between the second and third insulating layers 48, 54. The cooling ducts 52 are initially held in place by a plurality of bands 226 of a glass fiber tape that are disposed around the layer 50 of cooling ducts 52. Of course, the formation of the third insulating layer 54, the second conductor layer 56 and the fourth insulating layer 62 over the layer 50 of cooling ducts 52 and the subsequent encapsulation of the entire coil 30 in the insulating resin 64 further secure the layer 50 of cooling ducts 52 in place.

Once a coil 30, 66, 116, 180, or 186 is constructed with the requisite number of insulating layers, conductor layers and layers of cooling ducts 52, the coil 30, 66, 116, 180, or 186 is removed from the winding mandrel 32 and is encapsulated with the insulating resin 64. Since the encapsulation method is similar for each of the coils 30, 66, 116, 180, or 186, the encapsulation method will only be described with regard to the coil 66 for purposes of brevity.

Figure 13:
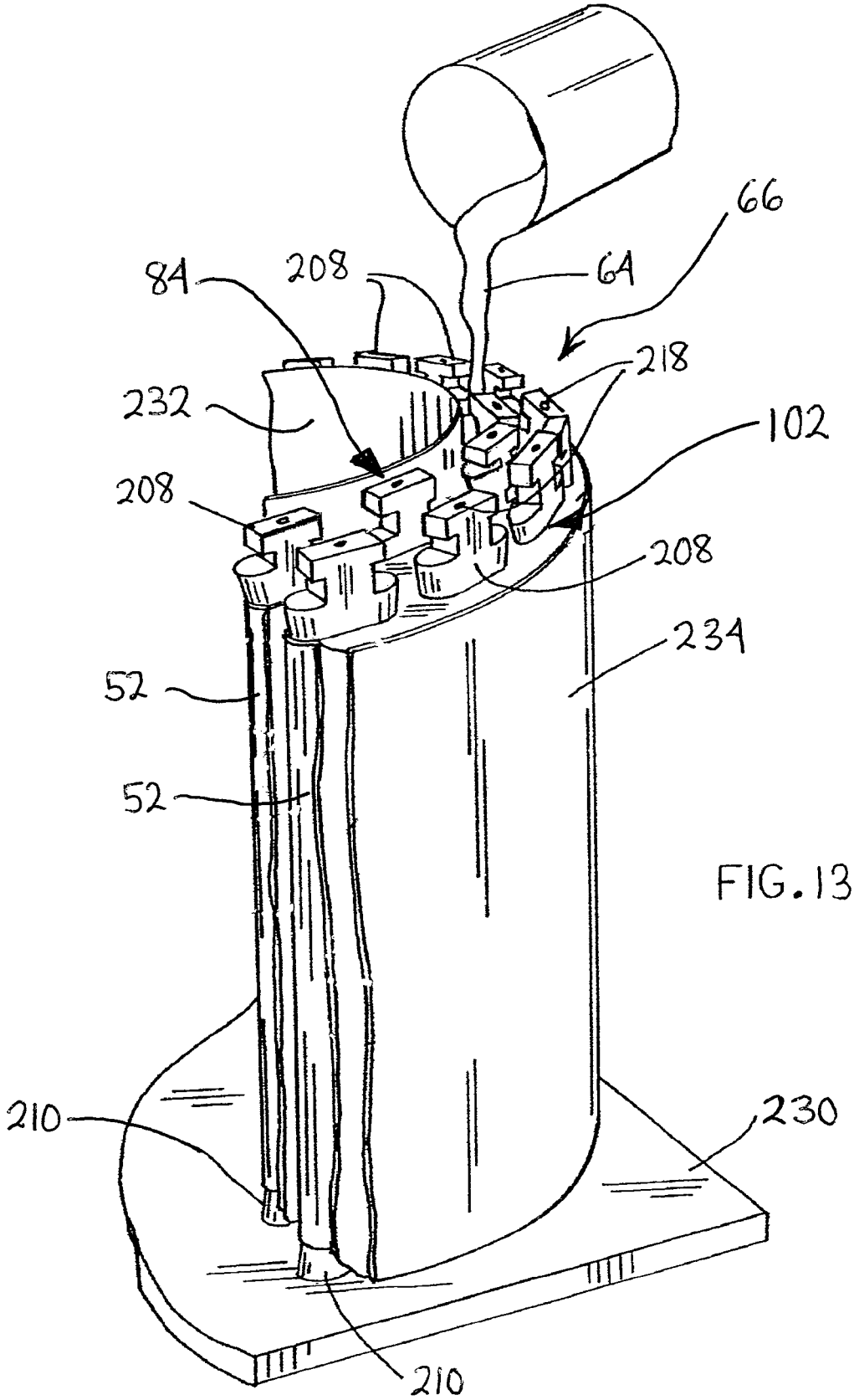
FIG. 13 shows a perspective cut-away view of a coil embodied in accordance with the present invention being encapsulated in an insulating resin.

Referring now to FIG. 13, the coil 66 is first pre-heated in an oven to remove moisture from the insulating layers and the conductor layers. The coil 66 is then placed on a mat 230 in a vacuum chamber in an upright position with the top end of the coil 66 and the top plugs 208 in the cooling ducts 52 facing upward. The mat 230 is comprised of silicone or other suitable material that may be compressed. With the coil 66 so positioned in the vacuum chamber, the flat ends of the bottom plugs 210 are pressed against the mat 230. A cylindrical inner mold 232 is disposed in the open center of the coil 66 and a cylindrical outer mold 234 is disposed around the upright coil 66. The inner and outer molds 232, 234 are each formed of sheet metal or other rigid material. The inner and outer molds 232, 234 are sized so as to leave gaps between the inner and outer molds 232, 234 and the coil 66. U.S. Pat. No. 6,221,297 to Lanoue et al., which is hereby incorporated by reference discloses one construction for the outer mold 234, but other suitable forms of molds well known in the art may be used. Compression of the inner and outer molds 232, 234 against the mat 230 will prevent the insulating resin 64 from leaking out of the bottoms of the inner and outer molds 232, 234 during the encapsulation process.

The vacuum chamber is evacuated to remove any remaining moisture and gases in the coil 66 and to eliminate any voids between adjacent turns in the disc windings 72, 74, 90, 92, 108. The insulating resin 64, which is flowable, is poured between the inner and outer molds 232, 234 to encapsulate the coil 66, and to encase the first and second layers 84, 102 of cooling ducts 52. The insulating resin 64 settles into the lower spaces between the inner and outer molds 232, 234 and surrounds the bottom plugs 210 to a depth substantially even with the flat portions of the bottom plugs 210. The insulating resin 64 is poured between the inner and outer molds 232, 234 until the insulating resin 64 extends about 3/16 of an inch above the top edges of the cooling duct 52 upper ends. The insulating resin 64 flows over and into the screen material 36 of the first through sixth insulating layers 70, 82, 86, 100, 104, 114 such that the insulating resin 64 fills the openings in the screen material 36 and the insulation gaps between the disc windings 72, 74, 90, 92, 108 and the cooling ducts 52 and the grid of the screen material 36. After a short time interval, which allows the insulating resin 64 to impregnate the screen material 36 of the first through sixth insulating layers 70, 82, 86, 100, 104, 114, the vacuum is released and pressure is applied to the free surface of the insulating resin 64. This will force the insulating resin 64 to impregnate any remaining voids in the first through sixth insulating layers 70, 82, 86, 100, 104, 114. The coil 66 is then removed from the vacuum chamber and placed in an oven to cure the insulating resin 64 to a solid.

The curing process in the oven is conventional and well known in the art. For example, the cure cycle may comprise a (1) gel portion for about 5 hours at about 85 degrees C., (2) a ramp up portion for about 2 hours where the temperature increases from about 85 degrees C. to about 140 degrees C., (3) a cure portion for about 6 hours at about 140 degrees C., and (4) a ramp down portion for about 4 hours to about 80 degrees C. Following curing, the inner and outer molds 232, 234 are removed. The top plugs 208 may be easily removed with pliers or other gripping devices without damaging the surrounding insulating resin 64. The bottom plugs 210 may be removed by inserting a bar or rod (not shown) through the top end of each cooling duct 52 and punching out the bottom plugs 210.

The insulating resin 64 may be an epoxy resin or a polyester resin. An epoxy resin has been found particularly suitable for use as the insulating resin 64. The epoxy resin may be filled or unfilled. An example of an epoxy resin that may be used for the insulating resin 64 is disclosed in U.S. Pat. No. 6,852,415, which is assigned to ABB Research Ltd. and is hereby incorporated by reference. Another example of an epoxy resin that may be used for the insulating resin 64 is Rutapox VE-4883, which is commercially available from Bakelite AG of Iserlohn of Germany.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of manufacturing a transformer comprising:

forming a disc-wound coil comprising:

forming a first conductor layer comprising a plurality of serially connected disc windings arranged in an axial direction of the disc-wound coil, each of the disc windings comprising a conductor wound into a plurality of concentric turns; and forming a second conductor layer over the first conductor layer so that the first and second conductor layers are disposed concentrically, the second conductor layer comprising a plurality of serially connected disc windings arranged in an axial direction of the disc-wound coil, each of the disc windings comprising a conductor wound into a plurality of concentric turns.

2. The method of claim 1, further comprising forming a layer of cooling ducts over the first conductor layer, before the step of forming the second conductor layer, the cooling ducts extending in the axial direction of the disc-wound coil and being arranged in a serial manner around a circumference of the disc-wound coil, wherein each cooling duct has an enclosed periphery and an open interior.

3. The method of claim 2, further comprising forming a layer of insulating material over the first conductor layer, before the step of forming the layer of cooling ducts.

4. The method of claim 2, wherein each of the cooling ducts is comprised of fiber-reinforced plastic.

5. The method of claim 1, wherein the conductor of the first conductor layer and the conductor of the second conductor layer are each comprised of metal foil.

6. The method of claim 1, further comprising:

forming a third conductor layer over the second conductor layer, said third conductor layer comprising a plurality of disc windings arranged in an axial direction of the disc-wound coil, each of the disc windings comprising a conductor wound into a plurality of concentric turns.

7. The method of claim 6, further comprising:

forming a first layer of cooling ducts over the first conductor layer, before the step of forming the second conductor layer;

forming a second layer of cooling ducts over the second conductor layer, before the step of forming the third conductor layer;

wherein in each of the first and second layers of cooling ducts, the cooling ducts extend in the axial direction of the disc-wound coil and are arranged in a serial manner around a circumference of the disc-wound coil.

8. The method of claim 6, wherein the first conductor layer and the second conductor layer are formed so that each of the first and second conductor layers comprise first and second groups of disc windings that are not directly connected together; and wherein the method further comprises connecting the first group of disc windings in the first conductor layer to the first group of disc windings in the second conductor layer, and connecting the second group of disc windings in the first conductor layer to the second group of disc windings in the second conductor layer.

9. The method of claim 8, further comprising connecting a disc winding of the third conductor layer at a first end of the disc-wound coil to the first group of disc windings in the second conductive layer and connecting another disc winding of the third conductor layer at a second end of the disc-wound coil to the second group of disc windings in the second conductive layer.

10. The method of claim 7, wherein the step of forming the first layer of cooling ducts and the step of forming the second layer of cooling ducts each comprise forming a first group of cooling ducts and forming a second group of cooling ducts such that the first group of cooling ducts is axially separated from the second group of cooling ducts.

11. The method of claim 10, wherein the step of forming the first layer of cooling ducts and the step of forming the second layer of cooling ducts each further comprise forming a third group of cooling ducts serially arranged with the first and second groups of cooling ducts along the axial direction of the disc-wound coil.

12. The method of claim 11, wherein the step of forming the first layer of cooling ducts and the step of forming the second layer of cooling ducts each further comprise forming a fourth group of cooling ducts serially arranged with the first, second and third groups of cooling ducts along the axial direction of the disc-wound coil.

13. The method of claim 10, wherein the first, second and third conductor layers are formed so as to each comprise first and second groups of disc windings arranged along the axial direction of the disc-wound coil.

14. The method of claim 13, wherein the first groups of cooling ducts and the first groups of disc windings help form a first section of the disc-wound coil, and the second groups of cooling ducts and the second groups of disc windings help form a second section of the disc-wound coil, the first and second sections being arranged along the axial direction of the disc-wound coil.

15. The method of claim 14, further comprising electrically connecting together the first and second sections using a conductor in the first conductor layer.

16. The method of claim 1, wherein the first and second conductor layers are each formed so as to comprises a group of at least three disc windings, wherein in each group, adjacent disc windings are directly connected together.

17. The method of claim 1, wherein the forming of the first conductor layer comprises winding the conductor from inside to outside to form a first of the disc windings and then winding the conductor form outside to inside to form a subsequent one of the disc windings.

18. The method of claim 1, wherein the forming of the first conductor layer comprises winding the conductor from inside to outside to form a first of the disc windings, forming a drop-down and then winding the conductor from inside to outside to form a subsequent one of the disc windings.

19. The method of claim 1, wherein the disc-wound coil is a first disc-wound coil and wherein the method further comprises forming a second disc-wound coil and forming a third disc-wound coil, wherein each of the second and third disc-wound coils are formed by:

forming a first conductor layer comprising a plurality of serially connected disc windings arranged in an axial direction of the disc-wound coil, each of the disc windings comprising a conductor wound into a plurality of concentric turns; and forming a second conductor layer over the first conductor layer so that the first and second conductor layers are disposed concentrically, the second conductor layer comprising a plurality of serially connected disc windings arranged in an axial direction of the disc-wound coil, each of the disc windings comprising a conductor wound into a plurality of concentric turns.

20. The method of claim 1, further comprising encapsulating the disc-wound coil in an epoxy resin.

* * * * *